US012480382B2

(12) United States Patent
Khan et al.

(10) Patent No.: US 12,480,382 B2
(45) Date of Patent: Nov. 25, 2025

(54) METHOD TO REDUCE CARBON LIFECYCLE THROUGH EFFECTIVE CAPTURE AND UTILIZATION

(71) Applicant: Schlumberger Technology Corporation, Sugar Land, TX (US)

(72) Inventors: Abdul Muqtadir Khan, Sugar Land, TX (US); Melissa Chia Mei Teoh, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/817,937

(22) Filed: Aug. 28, 2024

(65) Prior Publication Data

US 2025/0109664 A1 Apr. 3, 2025

Related U.S. Application Data

(60) Provisional application No. 63/586,677, filed on Sep. 29, 2023.

(51) Int. Cl.

| | |
|---|---|
| ***E21B 41/00*** | (2006.01) |
| ***E21B 43/16*** | (2006.01) |
| ***E21B 43/40*** | (2006.01) |

(52) U.S. Cl.

CPC ..... *E21B 41/0064* (2013.01); *E21B 43/164* (2013.01); *E21B 43/40* (2013.01)

(58) Field of Classification Search

CPC .... E21B 43/164; E21B 43/26; E21B 41/0064; E21B 43/16; E21B 43/247; E21B 43/25; E21B 43/2605; E21B 43/40

See application file for complete search history.

(56) References Cited

U.S. PATENT DOCUMENTS

| | | | |
|---|---|---|---|
| 11,585,802 | B1 | 2/2023 | Qi et al. |
| 2010/0318337 | A1 | 12/2010 | Bailey et al. |
| 2014/0236549 | A1* | 8/2014 | Le Ravalec ..... E21B 43/16 703/2 |
| 2014/0352984 | A1 | 12/2014 | Enis et al. |
| 2015/0013977 | A1 | 1/2015 | Palmer et al. |
| 2016/0040531 | A1 | 2/2016 | Ramakrishnan et al. |
| 2016/0222774 | A1 | 8/2016 | Rhodes et al. |

(Continued)

FOREIGN PATENT DOCUMENTS

| | | | |
|---|---|---|---|
| EP | 4219889 | A1 | 8/2023 |
| WO | 2007076044 | A2 | 7/2007 |

(Continued)

OTHER PUBLICATIONS

Burnside, N.M. et al., Review and implications of relative permeability of CO2/brine systems and residual trapping of CO2, International Journal of Greenhouse Gas Control, Apr. 2014, pp. 1-11, vol. 23.

(Continued)

*Primary Examiner* — Zakiya W Bates
(74) *Attorney, Agent, or Firm* — Jeffrey D. Frantz

(57) ABSTRACT

The present disclosure provides multiple embodiments related to methods for carbon capture. Carbon dioxide may be obtained from an industrial carbon dioxide generator and then effectively used as feedstock for a carbon dioxide use facility or may be sequestered at a wellhead until use is required as a feedstock at a later time.

20 Claims, 4 Drawing Sheets

(56) References Cited

U.S. PATENT DOCUMENTS

| | | | | |
|---|---|---|---|---|
| 2016/0230062 | A1 | 8/2016 | Beuterbaugh et al. | |
| 2020/0284945 | A1 | 9/2020 | Khan et al. | |
| 2023/0266501 | A1* | 8/2023 | Vice | E21B 47/06 702/12 |
| 2024/0141767 | A1* | 5/2024 | Wang | E21B 43/164 |
| 2024/0392654 | A1 | 11/2024 | Beletskaya et al. | |

FOREIGN PATENT DOCUMENTS

| | | | |
|---|---|---|---|
| WO | 2021188961 | A1 | 9/2021 |
| WO | 2023092011 | A1 | 5/2023 |
| WO | 2023177305 | A1 | 9/2023 |

OTHER PUBLICATIONS

Bai, M. et al., Relative Permeability Characteristics During Carbon Capture and Sequestration Process in Low-Permeable Reservoirs, Materials, Feb. 20, 2020, pp. 1-15, vol. 13, Issue 4.

Search Report and Written Opinion of International Patent Application No. PCT/US2024/044216 dated on Dec. 10, 2024, 8 Pages.

Search Report and Written Opinion of International Patent Application No. PCT/US2024/044227 dated on Dec. 12, 2024, 10 Pages.

Search Report and Written Opinion of International Patent Application No. PCT/US2024/044231 dated on Dec. 12, 2024, 11 Pages.

* cited by examiner

METHOD TO REDUCE CARBON LIFECYCLE THROUGH EFFECTIVE CAPTURE AND UTILIZATION

CROSS-REFERENCE TO RELATED APPLICATIONS

The current application claims priority to U.S. Provisional Patent Application 63/586,677, filed Sep. 29, 2023, the entirety of which is incorporated by reference.

FIELD OF THE DISCLOSURE

Aspects of the disclosure relate to carbon capture technologies. More specifically, aspects of the disclosure relate to a method to reduce carbon lifecycle through capture technology based at generators as well as utilization of captured carbon as feedstock in industry. Other aspects allow for sequestration of carbon at a wellhead.

BACKGROUND

Carbon capture, utilization, and storage, hereinafter "CCUS" provides opportunities for industry to effectively sequester free carbon dioxide and beneficially use the carbon dioxide when and where needed. To date, CCUS has been a well-recognized and studied field within industry. The hydrocarbon recovery industry in particular has shown interest in providing environmental benefit from eliminating problematic greenhouse gases.

Referring to FIG. 1, a typical schematic demonstrating the flow and value chain of typical CCUS operations is illustrated. This flow and value chain highlights the current, benchmark, lifecycle of carbon. Generally, the objective of CCUS is to reduce the carbon footprint in an effectively engineered way. While the objectives are clear, there is significant technical complexity, time, and economic expense at all levels of the value and technology chain. Some issues with CCUS technologies are described in more detail below:

1) Gaseous carbon dioxide is captured from multiple industrial sources that produce the gas. Such generators may include heavy industry and electrical generation facilities that burn hydrocarbons (upper left of FIG. 1).
2) Gaseous carbon dioxide may be obtained directly from the atmosphere itself. As will be understood, gaseous carbon dioxide may be more prevalent in areas with numerous industrial sources and/or electrical generation facilities that burn hydrocarbons (center left of FIG. 1).

In either scenario (1 or 2, above), the carbon dioxide must be acquired, compressed, and stored (bottom of FIG. 1) until a time for utilization arrives (upper right of FIG. 1). In scenarios where a continuous, gaseous stream of carbon dioxide is obtained from industry or the atmosphere, significant infrastructure investment is required for pipelines (center of FIG. 1) or transportation (center of FIG. 1). Transportation may take several forms, such as trucking, rail, or ship. To maintain these capital expenditures, operational costs are also incurred to keep the facilities operational. Currently, conventional technologies add incremental carbon emissions through fuel emissions and increase the net carbon balance.

In the event that transport is long, intermediate storage areas may be required to store the carbon dioxide. Such intermediate storage areas have their own capital and maintenance costs, may also require receipt facilities for loading and unloading, and need various types of compression technologies for safe storage and transportation. Additionally, facilities may also require significant electrical usage to actively maintain the carbon dioxide at required temperatures and pressures.

There is a need to provide an apparatus and methods that are easy to operate for owners of such facilities as compared with costly conventional apparatus and methods for capture and sequestration.

There is a further need to provide apparatus and methods that do not have the drawbacks discussed above, namely large amounts of capital and maintenance costs as well as incremental carbon dioxide production that results from operating of such facilities.

There is a still further need to reduce economic costs associated with CCUS operations and apparatus described above.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are; therefore, not to be considered limiting of its scope, for the disclosure may admit to other equally effective embodiments without specific recitation. Accordingly, the following summary provides just a few aspects of the description and should not be used to limit the described embodiments to a single concept.

In one embodiment, a method to use and capture carbon dioxide is disclosed. The method may comprise obtaining a source of carbon dioxide. The method may further comprise transporting the source of carbon dioxide to a wellsite. The method may further comprise injecting the carbon dioxide into a wellbore at the wellsite for a wellbore purpose. The method may further comprise after completion of the wellbore purpose, capturing the injected carbon dioxide from the wellbore. The method may further comprise transporting the captured injected carbon dioxide from the wellbore to a second wellbore. The method may also further comprise injecting the captured injected carbon dioxide into a second wellbore for a second wellbore purpose.

In another example embodiment, an article of manufacture is disclosed. The article of manufacture configured with a non-volatile memory, the non-volatile memory configured to allow a computer to read a list of instructions to enable actuation of equipment to perform a method of using captured carbon dioxide, the method comprising obtaining a source of carbon dioxide. The method further comprising transporting the source of carbon dioxide to a wellsite. The method further comprising injecting the carbon dioxide into a wellbore at the wellsite for a wellbore purpose. The method further comprising after completion of the wellbore purpose, capturing the injected carbon dioxide from the wellbore. The method further comprising transporting the captured injected carbon dioxide from the wellbore to a second wellbore. The method further comprising injecting the captured injected carbon dioxide into a second wellbore for a second wellbore purpose.

In another example embodiment, a method recycling carbon dioxide for a beneficial use is disclosed. The method may comprise obtaining a source of carbon dioxide from one of an electrical generating station using hydrocarbons and an industrial facility. The method may further comprise transporting a volume of carbon dioxide obtained from the source to a wellsite. The method may further comprise injecting the carbon dioxide into a wellbore at the wellsite for a wellbore purpose, the wellbore purpose being one of fracturing of a geological stratum, wellbore intervention, and geological stratum stimulation. The method may further comprise after completion of the wellbore purpose, capturing the injected carbon dioxide from the wellbore. The method may further comprise purifying the carbon dioxide captured from the wellbore to produce a purified carbon dioxide. The method may further comprise transporting the purified carbon dioxide to a second wellbore. The method may also further comprise injecting the purified carbon dioxide into a second wellbore for a second wellbore purpose.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are; therefore, not be considered limiting of its scope, for the disclosure may admit to other equally effective embodiments.

Figure 1:
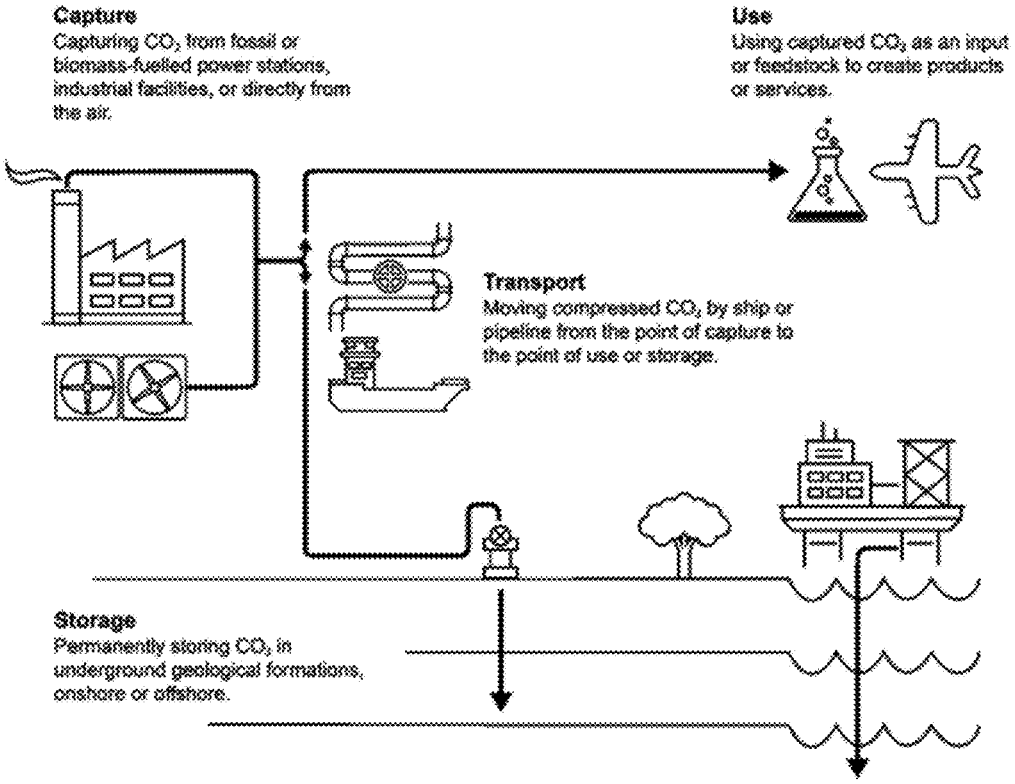
PRIOR ART FIG. 1
FIG. 1 is a typical schematic demonstrating the chain of typical carbon capture operations highlighting the current, benchmark, lifecycle of carbon.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer or section. Terms such as "first", "second", and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on", "engaged to", "connected to," or "coupled to" another element or layer, it may be directly on, engaged, connected, coupled to the other element or layer, or interleaving elements or layers may be present. In contrast, when an element is referred to as being "directly on", "directly engaged to", "directly connected to", or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood; however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure provide a method, and associated apparatus, to improve systems related to the carbon capture lifecycle. Improvements to the carbon capture lifecycle include aspects such as capital cost, maintenance cost, and technical complexity. Each component of the CCUS provides method steps to overcome such shortcomings that to date, have not been achieved by conventional apparatus.

In one non-limiting example embodiment, effective utilization of carbon dioxide may be done in accordance with an enhanced oil recovery project. In another non-limiting example embodiment, the utilization of carbon dioxide is performed in a fracturing and wellbore intervention project. In another non-limiting example embodiment, portions of fluids used in such processes may use carbon dioxide. In fracturing, stimulation, and intervention fluids, up to 100 percent of the fluids used for these purposes may be used.

In embodiments, the fluids (carbon dioxide) may be used to conduct a specific purpose. The carbon dioxide may then be vented and captured after performance of the required function. Such capture may be performed, for example, by establishing a tanker truck connection to the wellhead for evacuation of the carbon dioxide. The recaptured carbon dioxide may then be reused at another facility, thereby limiting the overall costs and transportation of other fluids.

Capturing of carbon dioxide may be performed in other ways. Capture may be done through a pumping operation and transferred to an on-site carbon dioxide storage tank. Wellbores that are similarly situated may then use the centralized on-site carbon dioxide storage and pumping equipment, lowering overall costs of production by eliminating repetitive equipment.

Figure 2:
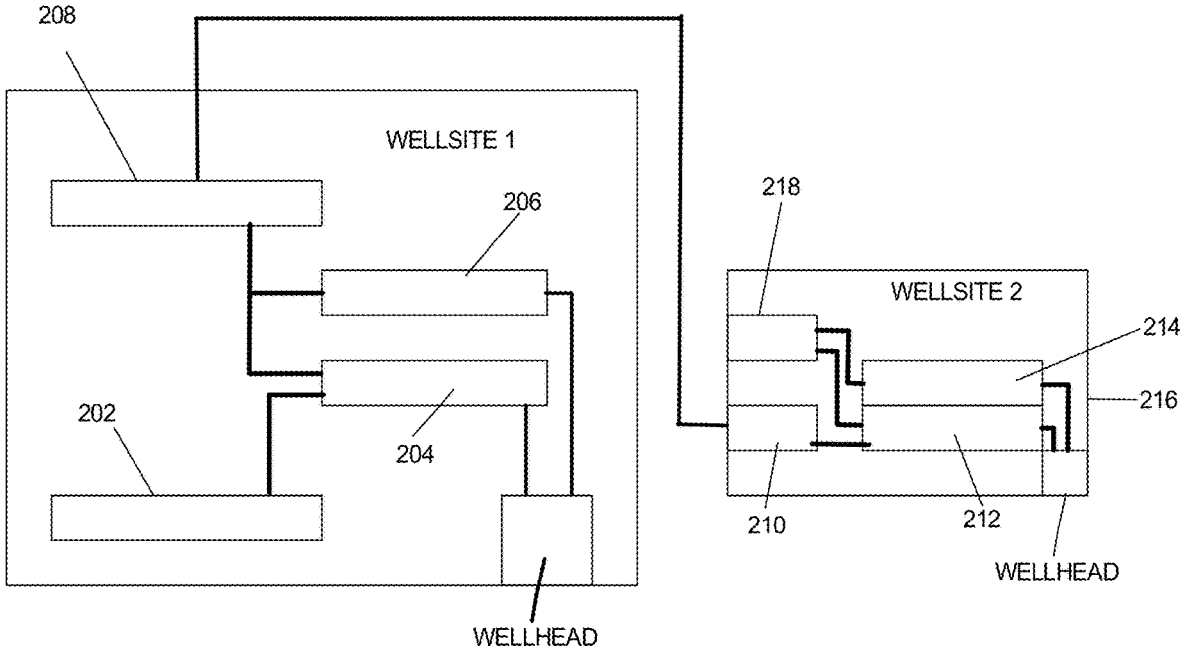
FIG. 2 is a typical depiction of the carbon capture in a tank in one example embodiment of the disclosure.

Referring to FIG. 2, a carbon dioxide storage tank 202 may be situated near fracturing equipment 204. A first skid of fracturing equipment 204 may be used, or as in the illustrated embodiment, a second skid of fracturing equipment 206 may be used. The skids 204, 206 may have pumps that are capable of pumping carbon dioxide at pressures needed, to perform downhole wellbore operations. As is understood, carbon dioxide is compressible, therefore knowing the potential volume that is to be filled with gas, an appropriate amount of carbon dioxide may be pumped downhole. Accordingly, the storage tank 202 may be sized to store the required amount of carbon dioxide necessary.

The first skid of fracturing equipment 204 and the second skid of fracturing equipment 206 may be equipped with different types of pumps to convey the carbon dioxide into the downhole. The different types of pumps that may be used include positive displacement compressors, reciprocating compressors, diaphragm compressors, and rotary compressors, as non-limiting embodiments. Over-pressure protection may be added to the pumping systems, wherein above a prescribed threshold, a safe exit is provided for the carbon dioxide if the threshold pressure is exceeded. One such embodiment provides for a pressure relief connection from the pumps on both the first skid of fracturing equipment 204 and the second skid of fracturing equipment 206 to a capture tank 208. A capture tank 208 may also be used to have the function of providing an evacuation route for downhole carbon dioxide after conclusion of the wellbore activities. The capture tank 208 may be a movable tank that may be transported from one wellsite to another. In other non-limiting embodiments, the capture tank 208 may be hard piped to a carbon dioxide filling tank 210 located at a second wellsite. The carbon dioxide filling tank 210 may be connected to a third skid of fracturing equipment 212 and a fourth skid of fracturing equipment 214.

Operations at the second wellsite 216 may be conducted similarly to the first wellsite, wherein the third skid of fracturing equipment 212 and the fourth skid of fracturing equipment 214 are configured with pumps that convey volumes and desired pressures of carbon dioxide for use downhole. As before, over pressure protection may be added to the pumping systems, wherein above a prescribed threshold, a safe exit is provided for the carbon dioxide if the threshold pressure is exceeded. One such embodiment provides for a pressure relief connection from the pumps on both the third skid of fracturing equipment 212 and the fourth skid of fracturing equipment 214 to second capture tank 218. Second capture tank 218 may be mobile by design or may be hard piped to another wellsite to continue the cycle.

One advantageous use of carbon dioxide in such pumping regimes is that carbon dioxide is relatively safe. Pumping of carbon dioxide would be performed where the overbearing cap rock is not brittle, thereby limiting potential leaks. As exposure of water to carbon dioxide will produce carbonic acid, exposure of carbonic acid to downhole geological stratum may free different species of metals, such as aluminum. Free metals in drinking water are specifically regulated, therefore attempts to minimize free metals are usually undertaken for health and safety reasons. In areas that do not use groundwater in the local hydrocarbon reservoirs, pumping of carbon dioxide provides environmental health of the area. The pumping of the inert gas in the wellbore will also prevent an oxygen rich environment and prevent corrosion of the wellbore casing.

Figure 3:
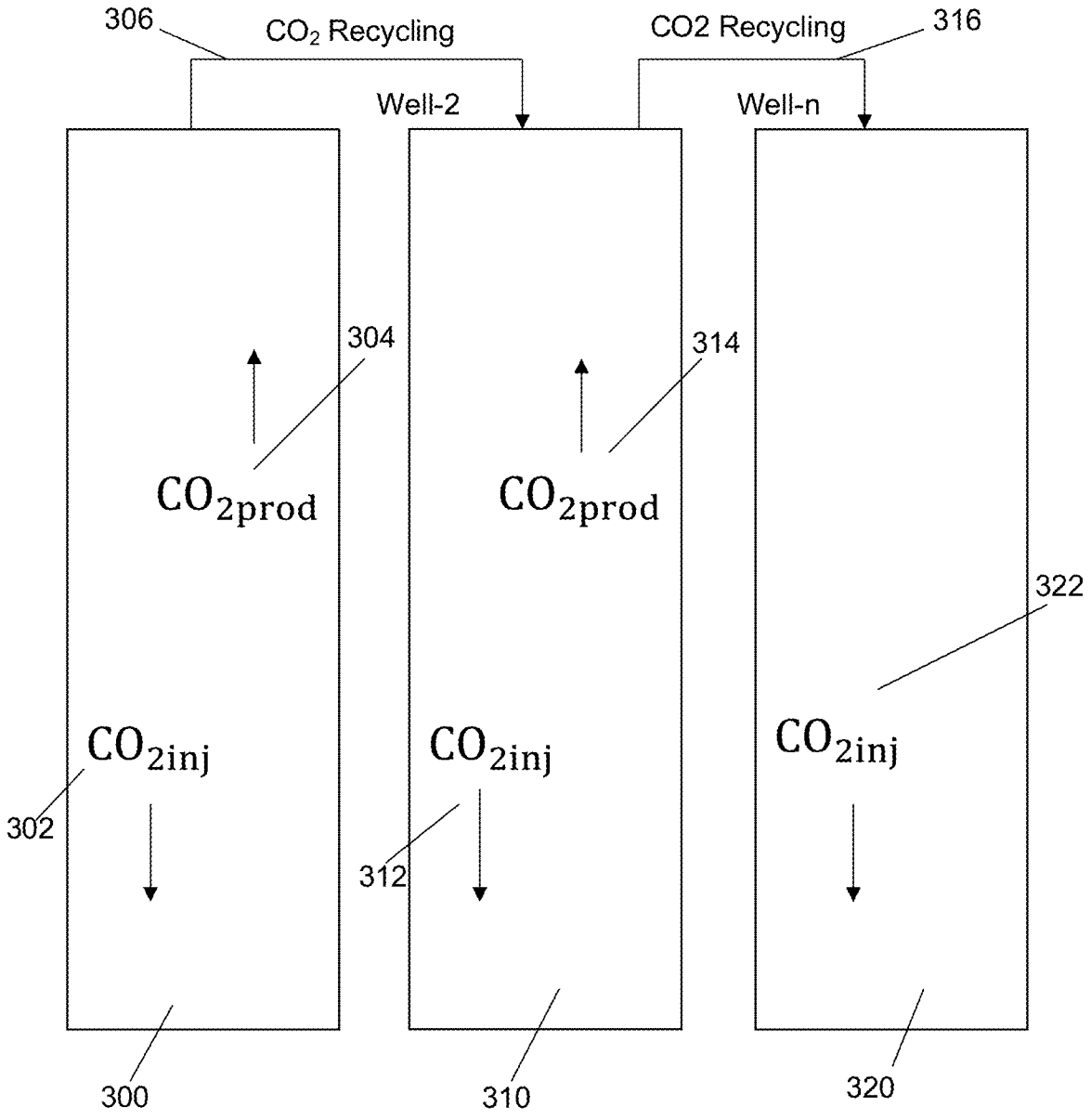
FIG. 3 depicts the carbon dioxide being recycled as injection fluid into nearby wells.

Similar principles can be utilized with the produced carbon dioxide from a first well to a second well, as described above. Referring to FIG. 3, such a process is illustrated. Three wellbores 300, 310, and 320 are illustrated. The first wellbore 300 may have an injection of carbon dioxide 302 into the wellbore 300 to facilitate a wellbore function. In one example embodiment, the wellbore function is as an aid in fracturing the downhole stratum. After the process of fracturing of the downhole stratum is completed, the carbon dioxide is removed from the wellbore by pumping or venting 304 and the amount of carbon dioxide is captured and recycled at 306 to a second wellbore 310 where it is injected at 312. The fracturing equipment injects the recycled carbon dioxide into the second wellbore 310. After the wellbore function is completed in the second wellbore 310, the carbon dioxide is vented and/or pumped 314 from the second wellbore 310 and recycled 316 a second time. This second recycling 316 may again be injected at 322 into a third wellbore 320 for use a third time for a wellbore function.

Although not shown, other processes may be used in conjunction with the carbon dioxide recycling at 306 and 316. For example, for each of the recycling 306, 316, a gas separation process may be conducted. Gas separation removes impurities from a gas stream. Thus, in gas separation from a wellsite, for example, various gaseous hydrocarbons may escape the wellbores 300, 310, 320 with the pumping or venting of the carbon dioxide. Through gas separation, these volatile hydrocarbons may be scrubbed or removed from the carbon dioxide gas stream, providing a clean gas stream that is used in the recycle processes 306, 316. One particularly efficient method for cleaning the gas stream being recycled is to cool and condense the gaseous carbon dioxide. Other types of separation technologies may be used. Amine scrubbing, for example, may be used to remove hydrogen sulphide that is often prevalent in hydrocarbon reservoirs. One non-limiting embodiment of an amine that may be used in such embodiments may be mono-ethanolamine (MEA).

Other types of gas separation techniques may be used in addition to or in place of separation by amines. Solid sorbents, such as zeolites and activated carbon may be used to separate gases. Other technologies may also be used, such as membrane technologies and cryogenics.

Other efficiencies may be achieved in the carbon dioxide lifecycle. Optimization algorithms coupled with control equipment, can be used to control carbon dioxide among a grid of different wellsites that are co-located. In one non-limiting example embodiment, grid-based searches as well as planning can be used. An example of such an algorithm is Dijkstra's algorithm, A* search (with Euclidean distance as heuristic) or concurrent variation of Dijkstra's algorithm, etc., to ensure that the carbon dioxide is being moved to the most efficient distances. An additional efficiency of the described technologies is that the carbon dioxide is immediately used, preventing excessive times of cooling of carbon dioxide.

Embodiments of the disclosure may use carbon dioxide as a fluid to conduct fracturing of a geological stratum. Utilization principles for stimulation are extensively studied and established due to the enhancement of production performance, faster fluid recovery, and reduction of freshwater utilization. In fracturing applications, multiple cap rock layers exist with high capillary forces, which make for robust structural trapping for the carbon dioxide pumped during fracturing, stimulation, or intervention. Also, residual trapping features due to carbon dioxide residual saturation exist, supporting the idea of not recovering all of the carbon dioxide on the surface during the production lifecycle of the well.

The types of wellsites that may use such methods vary. Onshore and offshore locations may be used. The methods used may be used in conventional, tight gas/oil, geothermal, or unconventional formations. Embodiments may be used in different functions, including, but not limited to proppant fracturing, acid fracturing, matrix acidizing, foam-based treatments, energized treatments, coilfrac, frac-n-pack, sand control, or water control treatments. Other uses may include wellbore cleanout, plug milling/plug drillout, wellbore displacement, pump down during perforating with shaped charges, pumping during perforating with abrasive material, and other intervention techniques where pumping fluids downhole is required.

Different types of wellsites may use the technologies described. The different types of wellsites may include, but not be limited to various conveyance types, such as, coiled tubing, coiled tubing with fiber optics, wireline cable, wireline cable with fiber optics, and slickline. All completion types for wellbores may also use the methods described including cemented cased hole, open hole, open hole with fracturing sleeves, and isolation packers and pre-perforated liners. The technologies may also be used in vertical, deviated, and horizontal wells.

Figure 4:
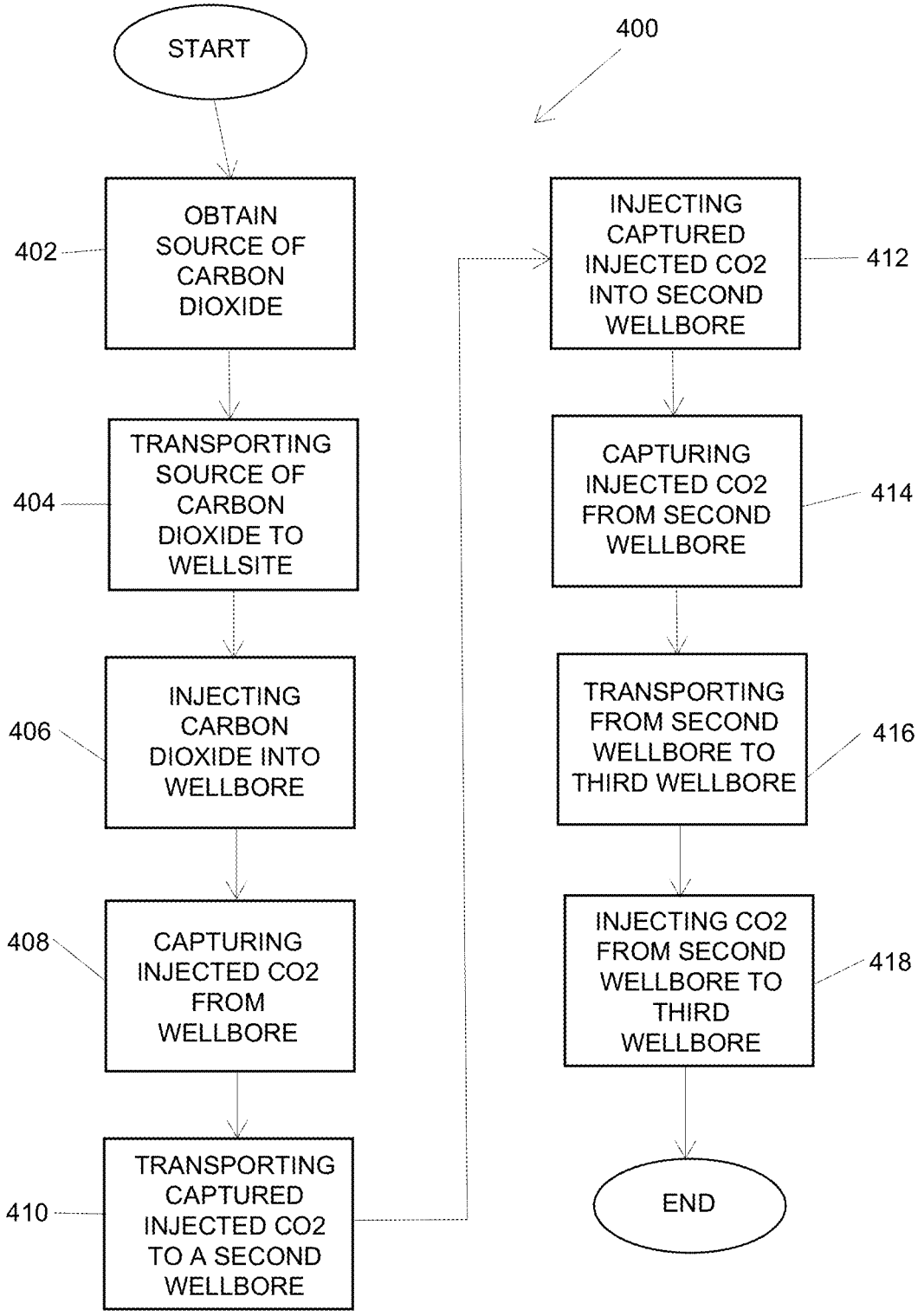
FIG. 4 is a method to reduce carbon lifecycle through effective capture and utilization in one example embodiment of the disclosure.

Referring to FIG. 4, a method 400 pertaining to the disclosure is presented. The method 400 presented should not be considered limiting. The method 400 may provide for, at 402, obtaining a source of carbon dioxide. The method 400 may also provide for, at 404, transporting the source of carbon dioxide to a wellsite. The method 400 may also provide for, at 406, injecting the carbon dioxide into a wellbore at the wellsite for a wellbore purpose. The method 400 may also provide for, at 408, after completion of the wellbore purpose, capturing the injected carbon dioxide from the wellbore. The method 400 may also provide for, at 410, transporting the captured injected carbon dioxide from the wellbore to a second wellbore. The method 400 may also provide for, at 412, injecting the captured injected carbon dioxide into a second wellbore for a second wellbore purpose. The method 400 may also provide for, at 414, after completion of the second wellbore purpose, capturing the injected carbon dioxide from the second wellbore. The method 400 may further provide for, at 416, transporting the captured injected carbon dioxide from the second to a third wellbore. The method 400 may further provide for, at 418, injecting the captured injected carbon dioxide from the second wellbore into the third wellbore for a third wellbore purpose.

In other embodiments, the method steps described above, may be performed through a computer system actuating different equipment connected to the computer. In embodiments, the method described can be coded into a set of instructions, readable by computer, to achieve results. To this end, a non-volatile memory may be used to store the set of instructions to be executed. Example embodiments; therefore, include methods performed by a computer or computer system. Such computers or computer systems may use artificial intelligence for aid in operations and selection of correct method steps. In embodiments, the set of instructions may be placed on a universal serial bus device, a computer hard drive, a solid-state memory system, an internet enabled computer, and/or a cloud computing device.

Example embodiments of the claims will now be disclosed. The recitation of these embodiments should not be considered as limiting the scope of the disclosure. In one embodiment, a method to use and capture carbon dioxide is disclosed. The method may comprise obtaining a source of carbon dioxide. The method may further comprise transporting the source of carbon dioxide to a wellsite. The method may further comprise injecting the carbon dioxide into a wellbore at the wellsite for a wellbore purpose. The method may further comprise after completion of the wellbore purpose, capturing the injected carbon dioxide from the wellbore. The method may further comprise transporting the captured injected carbon dioxide from the wellbore to a second wellbore. The method may also further comprise injecting the captured injected carbon dioxide into a second wellbore for a second wellbore purpose.

In another example embodiment, the method may be performed wherein the obtaining the source of the carbon dioxide is from an electrical generation facility.

In another example embodiment, the method may be performed wherein the obtaining the source of the carbon dioxide is from an industry.

In another example embodiment, the method may be performed wherein the obtaining the source of the carbon dioxide is from the atmosphere.

In another example embodiment, the method may be performed wherein the transporting of the source of the carbon dioxide to the wellsite is through vehicle transport.

In another example embodiment, the method may be performed wherein the vehicle transport is by one of a ship and truck.

In another example embodiment, the method may be performed wherein the wellbore purpose is at least one of fracturing of a geological stratum, stimulation of the geological stratum, and wellbore intervention.

In another example embodiment, the method may further comprise after completion of the second wellbore purpose, capturing the injected carbon dioxide from the second wellbore.

In another example embodiment, the method may further comprise transporting the captured injected carbon dioxide from the second to a third wellbore; and injecting the captured injected carbon dioxide from the second wellbore into the third wellbore for a third wellbore purpose.

In another example embodiment, the method may be performed wherein the third wellbore purpose is at least one of fracturing of a geological stratum, stimulation of a geological stratum, and wellbore intervention.

In another example embodiment, the method may be performed wherein the transporting of the captured injected carbon dioxide from the wellbore to a second wellbore is performed using an algorithm to reduce movement distance between wellsites.

In another example embodiment, the method may be performed wherein the algorithm is Dijkstra's algorithm.

In another example embodiment, the method may be performed wherein prior to at least one of injecting the captured injected carbon dioxide into the third wellbore, injecting the captured injected carbon dioxide into a second wellbore for a second wellbore purpose, and injecting the carbon dioxide into a wellbore at the wellsite for a wellbore purpose, carbon dioxide is subjected to gaseous separation.

In another example embodiment, the method may be performed wherein the gaseous separation is through one of membrane separation, amine separation, and solid sorbents.

In another example embodiment, an article of manufacture is disclosed. The article of manufacture configured with a non-volatile memory, the non-volatile memory configured to allow a computer to read a list of instructions to enable actuation of equipment to perform a method of using captured carbon dioxide, the method comprising obtaining a source of carbon dioxide. The method further comprising transporting the source of carbon dioxide to a wellsite. The method further comprising injecting the carbon dioxide into a wellbore at the wellsite for a wellbore purpose. The method further comprising after completion of the wellbore purpose, capturing the injected carbon dioxide from the wellbore. The method further comprising transporting the captured injected carbon dioxide from the wellbore to a second wellbore. The method further comprising injecting the captured injected carbon dioxide into a second wellbore for a second wellbore purpose.

In another example embodiment, the article of manufacture may be configured wherein the article of manufacture is one of a solid-state device, a universal serial bus, and a computer hard drive.

In another example embodiment, a method of recycling carbon dioxide for a beneficial use is disclosed. The method may comprise obtaining a source of carbon dioxide from one of an electrical generating station using hydrocarbons and an industrial facility. The method may further comprise transporting a volume of carbon dioxide obtained from the source to a wellsite. The method may further comprise injecting the carbon dioxide into a wellbore at the wellsite for a wellbore purpose, the wellbore purpose being one of fracturing of a geological stratum, wellbore intervention, and geological stratum stimulation. The method may further comprise after completion of the wellbore purpose, capturing the injected carbon dioxide from the wellbore. The method may further comprise purifying the carbon dioxide captured from the wellbore to produce a purified carbon dioxide. The method may further comprise transporting the purified carbon dioxide to a second wellbore. The method may also further comprise injecting the purified carbon dioxide into a second wellbore for a second wellbore purpose.

In another example embodiment, the method may be performed wherein the purifying is through one of gaseous separation, cooling and condensing and amine separation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method to use and capture carbon dioxide, comprising:

obtaining a source of carbon dioxide;

transporting the source of carbon dioxide to a wellsite;

injecting the carbon dioxide into a wellbore at the wellsite for a wellbore purpose;

after completion of the wellbore purpose, capturing the injected carbon dioxide from the wellbore utilizing a capture tank disposed at the wellbore;

transporting the captured injected carbon dioxide from capture tank at the wellbore to a second wellbore; and injecting the captured injected carbon dioxide into the second wellbore for a second wellbore purpose.

2. The method according to claim 1, wherein the obtaining the source of the carbon dioxide is from an electrical generation facility.

3. The method according to claim 1, wherein the obtaining the source of the carbon dioxide is from an industry.

4. The method according to claim 1, wherein the obtaining the source of the carbon dioxide is from the atmosphere.

5. The method according to claim 1, wherein the transporting of the source of the carbon dioxide to the wellsite is through vehicle transport.

6. The method according to claim 5, wherein the vehicle transport is by one of a ship and truck.

7. The method according to claim 1, wherein the wellbore purpose is at least one of fracturing of a geological stratum, stimulation of the geological stratum, and wellbore intervention.

8. The method according to claim 1, further comprising:

after completion of the second wellbore purpose, capturing the injected carbon dioxide from the second wellbore.

9. The method according to claim 8, further comprising:

transporting the captured injected carbon dioxide from the second wellbore to a third wellbore; and injecting the captured injected carbon dioxide from the second wellbore into the third wellbore for a third wellbore purpose.

10. The method according to claim 9, wherein the third wellbore purpose is at least one of a fracturing of a geological stratum, a stimulation of a geological stratum, and a wellbore intervention.

11. The method according to claim 9, wherein prior to at least one of injecting the captured injected carbon dioxide into the third wellbore, injecting the captured injected carbon dioxide into a second wellbore for a second wellbore purpose, and injecting the carbon dioxide into a wellbore at the wellsite for a wellbore purpose, carbon dioxide is subjected to gaseous separation.

12. The method according to claim 11, wherein the gaseous separation is through one of membrane separation, amine separation, and solid sorbents.

13. The method according to claim 1, wherein the transporting of the captured injected carbon dioxide from the wellbore to a second wellbore is performed using an algorithm to reduce movement distance between wellsites.

14. The method according to claim 13, wherein the algorithm is one of a path planning type algorithm, a Travelling salesman problem, an optimization algorithm using metaheuristics, and Dijkstra's algorithm.

15. The method according to claim 1, wherein the wellbore is selected where multiple cap rock layers exist with high capillary forces.

16. An article of manufacture configured with a non-volatile memory, the non-volatile memory configured to allow a computer to read a list of instructions to enable actuation of equipment to perform a method of using captured carbon dioxide, the method comprising:

obtaining a source of carbon dioxide;

transporting the source of carbon dioxide to a wellsite utilizing a transport;

injecting the carbon dioxide into a wellbore at the wellsite for a wellbore purpose;

after completion of the wellbore purpose, capturing the injected carbon dioxide from the wellbore;

transporting, utilizing the transport, the captured injected carbon dioxide from the wellbore to a second wellbore; and injecting the captured injected carbon dioxide into a second wellbore for a second wellbore purpose.

17. The article of manufacture according to claim 16, wherein the article of manufacture is one of a solid-state device, a universal serial bus, and a computer hard drive.

18. A method for recycling carbon dioxide for a beneficial use, comprising:

obtaining a source of carbon dioxide from one of an electrical generating station using hydrocarbons and an industrial facility;

transporting a volume of carbon dioxide obtained from the source to a wellsite;

injecting the carbon dioxide into a wellbore at the wellsite for a wellbore purpose, the wellbore purpose being one of fracturing of a geological stratum, wellbore intervention, and geological stratum stimulation, wherein the wellsite comprises a capture tank that provides a pressure relief connection while injecting the carbon dioxide;

after completion of the wellbore purpose, capturing the injected carbon dioxide from the wellbore utilizing the capture tank;

purifying the carbon dioxide captured from the wellbore to produce a purified carbon dioxide;

transporting the purified carbon dioxide to a second wellbore; and injecting the purified carbon dioxide into a second wellbore for a second wellbore purpose.

19. The method according to claim 18, wherein the purifying is through one of gaseous separation, cooling and condensing, and amine separation.

20. The method according to claim 18, wherein the first wellbore and the second wellbore are selected where the overbearing cap rock is not brittle.

* * * * *